United States Patent [19]

Strobele

[11] Patent Number: 4,745,619

[45] Date of Patent: May 17, 1988

[54] ELECTRODE ASSEMBLY FOR ELECTRIC ARC FURNACES

[76] Inventor: Kurt A. Strobele, 68 Barringham Drive, Oakville, Ontario, L6J 4P2, Canada, L6J 4P2

[21] Appl. No.: 896,294

[22] Filed: Aug. 13, 1986

Related U.S. Application Data

[63] Continuation of Ser. No. 547,474, Oct. 31, 1983, abandoned.

[51] Int. Cl.[4] ..... H05B 7/12

[52] U.S. Cl. ..... 373/96

[58] Field of Search ..... 277/12; 373/89, 91-95, 373/96, 97, 99, 100

[56] References Cited

U.S. PATENT DOCUMENTS

| | | | |
|---|---|---|---|
| 1,363,815 | 12/1920 | Saklatwalla et al. | 373/94 |
| 1,549,431 | 4/1925 | Beck | 373/95 |
| 1,690,795 | 11/1928 | Sagramoso | 373/96 |
| 1,732,431 | 10/1929 | Bruggmann | 373/95 |
| 2,193,434 | 3/1940 | Sem | 373/89 |
| 2,243,096 | 5/1941 | Hardin | 373/95 |
| 2,551,420 | 5/1951 | Conti | 373/95 |
| 2,871,278 | 1/1959 | Sandvold | 373/95 |
| 2,979,550 | 4/1961 | Sherman, Sr. | 373/95 |
| 2,982,804 | 5/1961 | Reschke | 373/95 |
| 3,379,816 | 4/1968 | Hozven | 373/99 |
| 4,295,001 | 10/1981 | Britton | 373/95 |
| 4,306,726 | 12/1981 | Lefebvre | 277/12 |
| 4,347,400 | 8/1982 | Lamarque | 373/95 |
| 4,438,516 | 3/1984 | Krogsrud | 373/97 |
| 4,490,825 | 12/1984 | Persson | 373/91 |

FOREIGN PATENT DOCUMENTS

| | | | |
|---|---|---|---|
| 0130687 | 8/1919 | United Kingdom | 373/95 |
| 2000947 | 1/1979 | United Kingdom . | |

*Primary Examiner*—Roy N. Envall, Jr.

[57] ABSTRACT

An electrode assembly for an electric arc furnace incorporates a water cooled sleeve which extends downwardly from an electrode clamp around a portion of a consumable electrode held by the clamp. During normal electrode movement, the sleeve is preferably telescopically received within, but spaced from, a water cooled annulus defining an opening in a furnace roof. A sliding seal is provided acting between the sleeve and the annulus, of a form which allows the sleeve to be lifted upwardly out of and re-inserted into engagement with the annulus. The annulus may be extended vertically to shroud the sleeve.

10 Claims, 7 Drawing Sheets

ELECTRODE ASSEMBLY FOR ELECTRIC ARC FURNACES

This application is a continuation, of application Ser. No. 547,474, filed Oct. 31, 1983 now abandoned.

FIELD OF THE INVENTION

This invention relates to improvements in electrode assemblies for electric arc furnaces, particularly but not exclusively arc furnaces used for steel making.

BACKGROUND OF THE INVENTION

In a widely used form of electric arc furnace, several, usually three, consumable graphite electrodes extend substantially vertically downwardly from electrode clamps, through apertures in the roof of the furnace (if a roof is provided) and into the furnace charge. In order to strike and maintain a proper arc during operation of the furnace, it is necessary to allow for significant vertical movement of the individual electrodes, whilst in the case of steel making furnaces, it must be possible to withdraw the electrodes sufficiently upward relative to the furnace roof to allow the latter to be swung clear of the remainder of the furnace structure. It must also be possible to feed the electrode downwardly relative to the clamp to compensate for erosion of the electrode tip during use.

Various problems are associated with the facts that a substantial distance separates the effective lower tip of each electrode and its supporting clamp, and that substantial vertical relative movement is necessary between the electrodes and the furnace roof. Gases may escape from the furnace between the electrode and the furnace roof, or if the furnace is operated at subatmospheric pressure, cold air may be drawn in through the same gap. The outer surface of the electrode is subject to erosion through oxidation caused by the hot gases within the furnace, and this problem is aggravated by heating of the electrode caused both by heat from the furnace interior and by electrical heating caused by the electrical resistance of the electrode to the current passing therethrough.

Two main approaches have been adopted in response to these problems. Firstly, various forms of telescoping seal have been proposed for use between individual electrodes and the furnace roof. For example, in French patent No. 1,418,153 (IRSID), a sleeve extending downwardly from the electrode clamp moves vertically in a water filled annular chamber extending upwardly from the furnace roof. In U.S. Pat. No. 4,306,726 (Lefebvre) a series of concentric sleeves with sliding seals provides a telescoping gas seal between the electrodes and the furnace roof. Both of these arrangements have the disadvantage that it is not practicable to accommodate the large range of vertical electrode movement required in a steel making furnace, whilst a major part of the weight of the seal structure must be supported by the furnace roof in an area where it is normally sought to avoid unnecessary loadings.

The second approach has been to seek reduction of heating of the electrode. Numerous proposals have been made for fluid (usually water) cooled electrode structures, which reduce the length of graphite electrodes required. Examples may be found in U.S. Pat. Nos. 4,121,042 and 4,168,392 (Prenn), 4,287,381 (Montgomery), French Patent No. 1,418,153 referred to above and French Patent Publication Nos. 2,176,546 and 2,222,821

(IRSID), German Patent Publication No. 2430817 (Sigri), British patent specification No. 1,223,162 (Ostberg) and Belgian Patent No. 867,876 (Korf-Stahl AG). All of these proposals have in common that the cooling arrangement is more or less complex and expensive, and that it is not possible continuously to add additional electrode sections to the top of the electrode to replace erosion from the bottom of the electrode. Rather, the entire electrode assembly must sooner or later be removed in order to replace the tip portion if this is consumable.

In British Patent Specification No. 664,298, an arrangement is proposed in which the electrode is supported within a water cooled sleeve, the lower end of which is in electrical contact with the electrode, and the upper end of which is held by the electrode clamp instead of the electrode itself. In this arrangement, the portion of the electrode within the sleeve does not have to transmit electric current, and the outer surface of this same portion is shielded from the electrode gases. In practice, it is extremely difficult to maintain adequate electrical contact between the bottom of the sleeve and the electrode. The arrangement described relies upon external screw threading of the electrode, both for transmitting current and for advancing the electrode through the sleeve, which means that electrodes of conventional design cannot be employed. Moreover, in order to achieve the object of the invention, the sleeve must extend close to the tip of the electrode. This is not practicable in many applications because of the risk that the sleeve will be damaged or destroyed by arcing from the furnace charge. An alternative approach is found described in U.K. Patent Specification No. 2000947A (Korf-Stahl AG) in which a water cooled jacket is provided around the electrode so as to shroud and support the entire electrode apart from the tip. In order to protect the jacket from arcing, it is insulated from the electrode, and provided with a refractory cladding. Additionally, an arc control magnet must be provided so as further to reduce the risk of arcing. The sleeve is supported from an electrode support arm which supports the electrode through a drive mechanism which also must maintain insulation between the electrode and the arm, a separate electrical connection being made to the electrode. It is suggested that the sleeve might be supported from a conductive electrode clamp, but in this case some arrangement would be necessary to isolate the sleeve electrically from the clamp. In order to maintain insulation between the sleeve and the electrode it is necessary to provide guides for the electrode within the lower part of the sleeve in a vulnerable position near the tip of the electrode.

SUMMARY OF THE INVENTION

I have now found a means of significantly reducing undesirable erosion of consumable electrodes in electric arc furnaces, and where applicable reducing or substantially preventing gas leakage between the electrodes and a furnace roof, whilst permitting a large range of vertical reciprocal movement of the electrode, without either unduly stressing the furnace roof or obstructing replacement of consumable electrodes by the coupling of additional electrode elements to the top end of the electrode.

According to the invention, a vertically movable electrode assembly for use with an electric arc furnace comprises a consumable electrode consisting of a plurality of consumable electrode elements coupled end to end in vertical alignment, an electrode clamp gripping and supporting said electrode at a level which will be above said furnace throughout the range of movement of said electrode, a fluid cooled sleeve extending downwardly from the electrode clamp around the electrode, the electrode being loosely shrouded by the sleeve, the vertical extent of the sleeve below the clamp being at least equal to the range of vertical movement of the assembly during normal operation of the furnace, but such that it ends short of arcing proximity of the highest anticipated level at which conductive material will occur within the furnace.

By use of such a sleeve depending from the electrode clamp, a useful degree of shielding and cooling of a vulnerable portion of the electrode is achieved, without in any way obstructing normal advance of the electrode through the clamp, and without obstructing vertical movement of the electrode. It is unnecessary to insulate the sleeve electrically from the electrode clamp, and unnecessary and undesirable to provide guides for the electrode within the sleeve.

Preferably, the assembly further includes means for defining a passageway for the electrode through a roof of the furnace, the vertical extent of the sleeve being such that it will extend into the passageway throughout the normal range of movement of the assembly. This provides some degree of restriction of the gap through which gases may pass around the electrode, and provides some shielding of the roof structure. Apart from the passageway defining means, no additional load is applied to the furnace roof, and the arrangement is well adapted to the provision of a more effective electrode seal.

Preferably also a sliding annular seal is provided acting between the sleeve and the passageway defining means when the sleeve extends into the latter. In one arrangement the seal is retained for axial sliding movement on the external surface of the sleeve. In an alternative arrangement, the seal is retained by the passageway defining means and defines a tapered top entrance thereto for the bottom end of the sleeve.

SHORT DESCRIPTION OF THE DRAWINGS

DESCRIPTION OF THE PREFERRED EMBODIMENTS

Figure 1:
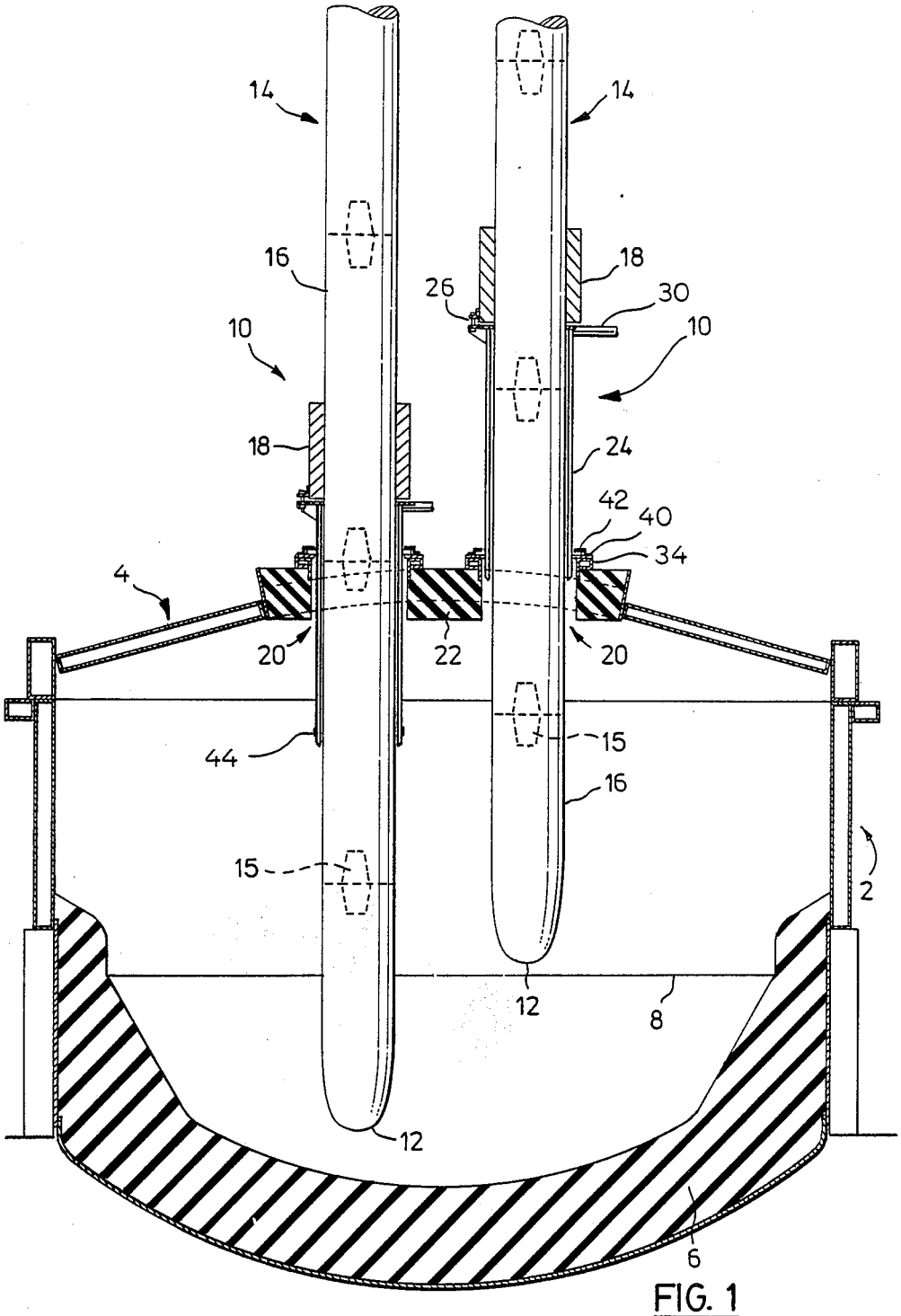
FIG. 1 is a vertical section through an electric arc furnace incorporating electrode assemblies in accordance with a first embodiment of the invention.

Referring first to FIG. 1, an illustrative electric arc furnace is shown. Since however the features of the furnace other than the electrode assemblies form no part of the invention, they will not be described in detail. The furnace 2 has a roof 4, and a refractory lining 6 for containing a charge which may have a maximum melt level 8. Means (not shown) are provided for swinging the roof 4 and electrode assemblies relative to the furnace, for example so that a fresh charge may be introduced. To permit this, it will be apparent that electrode assemblies 10 must be raised to a level such that the lower tips 12 of electrodes 14 will clear the remainder of the furnace structure. The electrodes shown are conventional consumable electrodes, formed by using standard couplings 15 to standard electrode elements 16 end to end in vertical alignment. The electrodes pass through conventional electrode clamps 18 which releasably support the electrodes so that the string of electrode elements can be moved through the clamp to compensate for the erosion which occurs at tip 12 as the electrode is consumed. The clamp also served to conduct current to the electrode. Particularly during the early stages of a melt, a substantial degree of up and down movement of electrodes may be necessary as an arc is struck and a desired current level maintained, and a further range of movement is necessary to accommodate erosion of the electrode between successive adjustments of the clamps 18. The clamps are supported, by means not shown, so as to provide this normal operating range of movement, together with the additional range of upward movement required when the roof of the furnace is to be swung as described above. To accommodate this movement the electrodes pass through openings or apertures 20 in a central electrically insulative portion 22 of the furnace roof. Although only two electrodes are actually shown in FIG. 1, there will normally be a group of three symmetrically placed electrodes connected to a three phase current supply.

Thus far, the elements described have been entirely conventional, and indeed it is a feature of the invention that it can readily be incorporated into existing furnace installations without major modification of the original structure of the latter. As compared with a conventional furnace structure, each electrode clamp supports a depending water cooled sleeve 24 which surrounds the portion of the electrode 14 beneath the clamp 18. The sleeve is supported from the electrode clamps by bolts 26, and a seal 28 is provided to prevent a through flow of gas between the sleeve and the electrode. The sleeve has water inlet and outlet connections 30 (only one is shown), and internal ribs 32 to strengthen the sleeve and guide the flow of water or alternative cooling fluid within the sleeve to provide effective cooling of the latter. The sleeve is preferably fabricated from non-magnetic stainless steel in order to resist corrosion and magnetically induced eddy currents. The vertical extent of the sleeve is such that during normal operation of the furnace, i.e. except during charging and initial start-up, it will at all times extend into the opening 20, as extended in this instance by a water cooled annulus 34 which is supplied with cooling water through connections 36 (again only one is shown). The annulus may also be fabricated from non-magnetic stainless steel.

In order to render unlikely the striking of an arc to the sleeve 24 and thus damaging it, and to minimize the adherence to the sleeve of material spattered within the furnace, the lower end of the sleeve ends well short of the lower end of the electrode. In practice, the extent of the sleeve should be such that it will never extend down to arcing proximity of a level at which conductive material is found in the furnace. This level will be above the maximum melt level 8 in the furnace by an amount depending on how "quietly" the furnace operates and the nature of the furnace charge. For example, in a furnace used for melting steel scrap, unmolten metallic material could contact the electrode substantially above the melt level, and the same could occur in other operations in which there is violent activity within the furnace.

Even this limited degree of shrouding provides very important advantages. Although the sleeve is dimensioned so that it is loose on the electrode and preferably spaced from it so that it will not obstruct longitudinal movement of the electrode 14 through the clamp 18, it will shroud the electrode sufficiently to eliminate any substantial sidewall oxidation of the electrode within the sleeve, and will provide significant cooling of this portion of the electrode. Even without the sealing arrangement to be described below, the sleeve will also act to restrict the flow of gases through the opening 20, and will shield the electrode from this flow.

Figure 2:
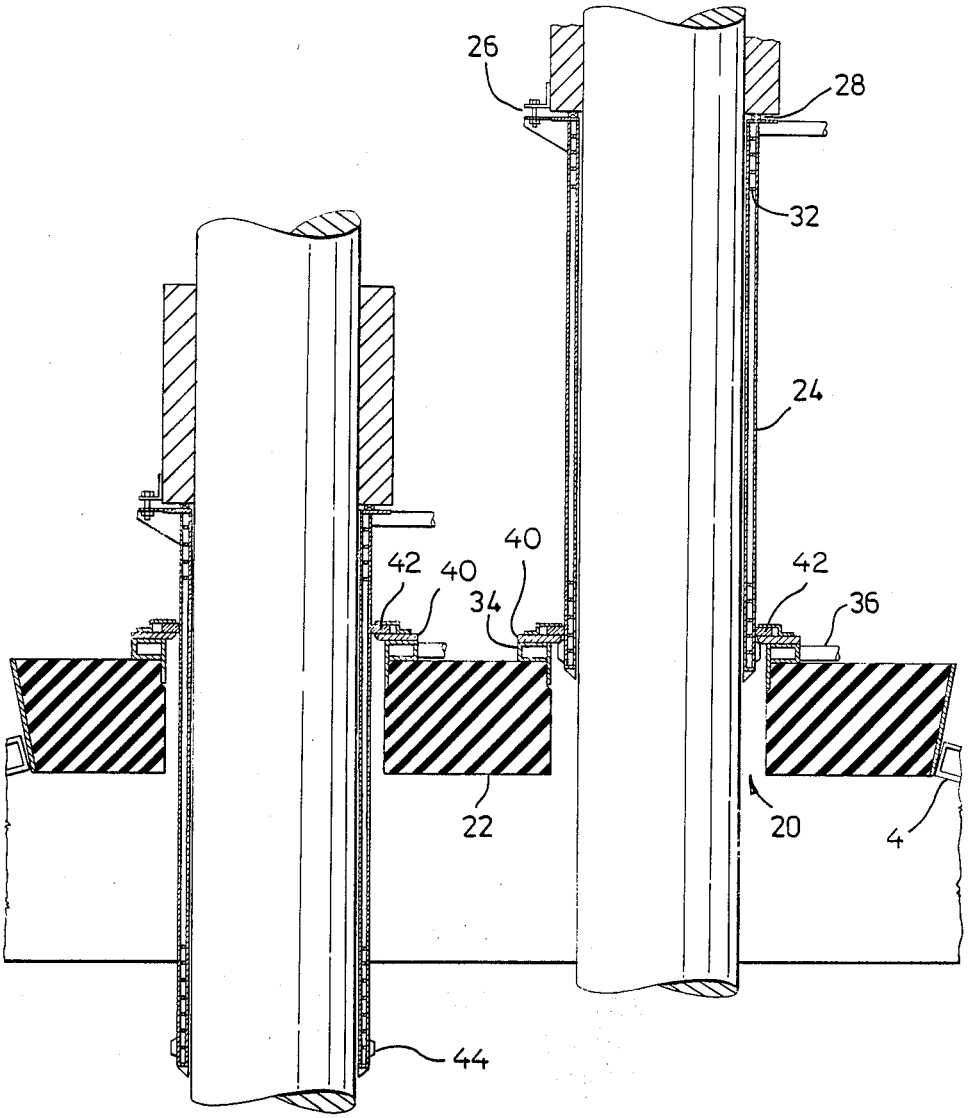
FIG. 2 is a fragmentary view on a larger scale showing additional detail of those portions of the electrode assemblies which differ from conventional practice.

The provision of the sleeve moreover makes it particularly easy to provide sealing of the opening 20 in a manner which will not obstruct upward movement of the electrode beyond its normal range of movement when it is desired to swing the furnace roof 4. As best seen in FIG. 2, a metallic sealing ring 40 rests on a seating formed by the annulus 34 and supports a high temperature seal element 42, for example of silica fibre, in sliding contact with the outer surface of the sleeve 24, so as to maintain a substantially gas-tight seal throughout the normal range of movement of the electrodes, this range being illustrated by the electrode assemblies shown on the right and left hand sides respectively of FIGS. 1 and 2. Since the seal elements slide on the water cooled surface of the sleeve 24, problems that would otherwise occur in maintaining a seal with the hot, rough and irregular surface of the electrode itself are eliminated. The annulus 34 not only provides a seating for the ring 40, but also defines the opening 20 and protects the fabric of the furnace roof.

Figure 3:
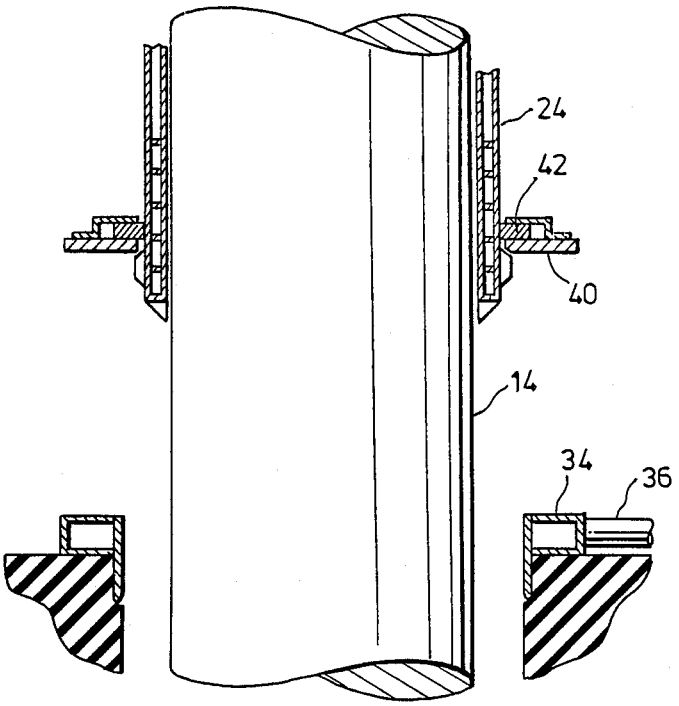
FIG. 3 is a fragmentary view on a still larger scale showing portions of the electrode assembly when the electrode is raised above its normal operating range of movements so as to permit swinging of the upper portion of the furnace to one side.

In order to provide for additional upward movement of the electrode, the sleeve is provided with a lip 44 at its lower end, which engages the sealing ring 40 and lifts it clear of the annulus 34 as shown in FIG. 3. The loss of sealing at this stage is not important, since it will usually occur only during short parts of the furnace operating cycle. The ability of the sealing ring 40 to lift from the annulus 34 will also prevent the seal 42 from being damaged should foreign matter adhere to the exterior of the sleeve 24.

Figure 5:
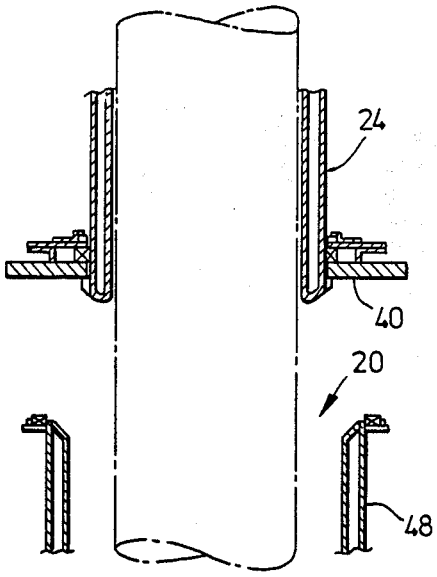
FIG. 5 is a view corresponding to FIG. 3 and showing the second embodiment.
Figure 4:
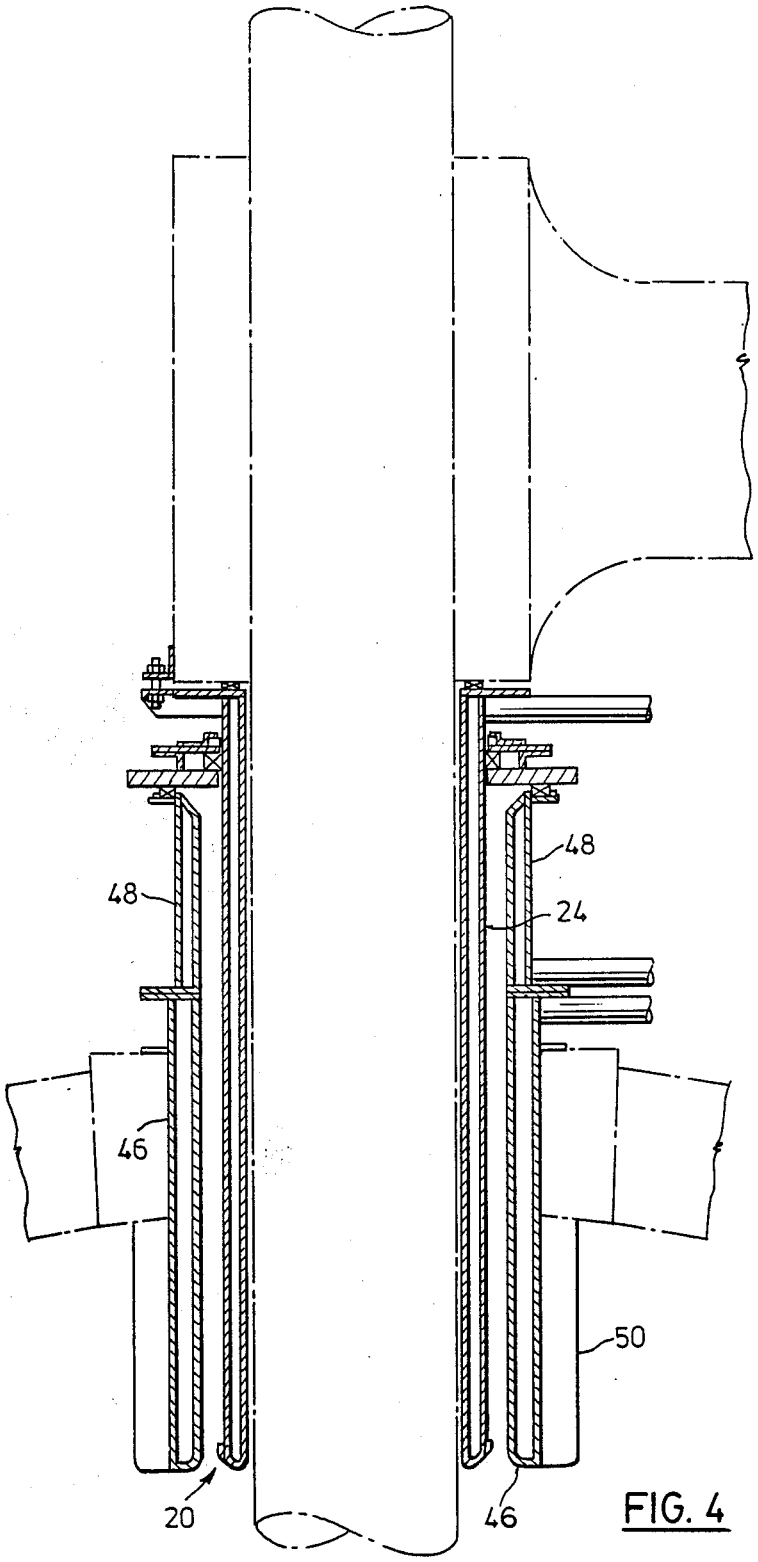
FIG. 4 is a view of part of an electrode assembly in accordance with a second embodiment of the invention.
Figure 6:
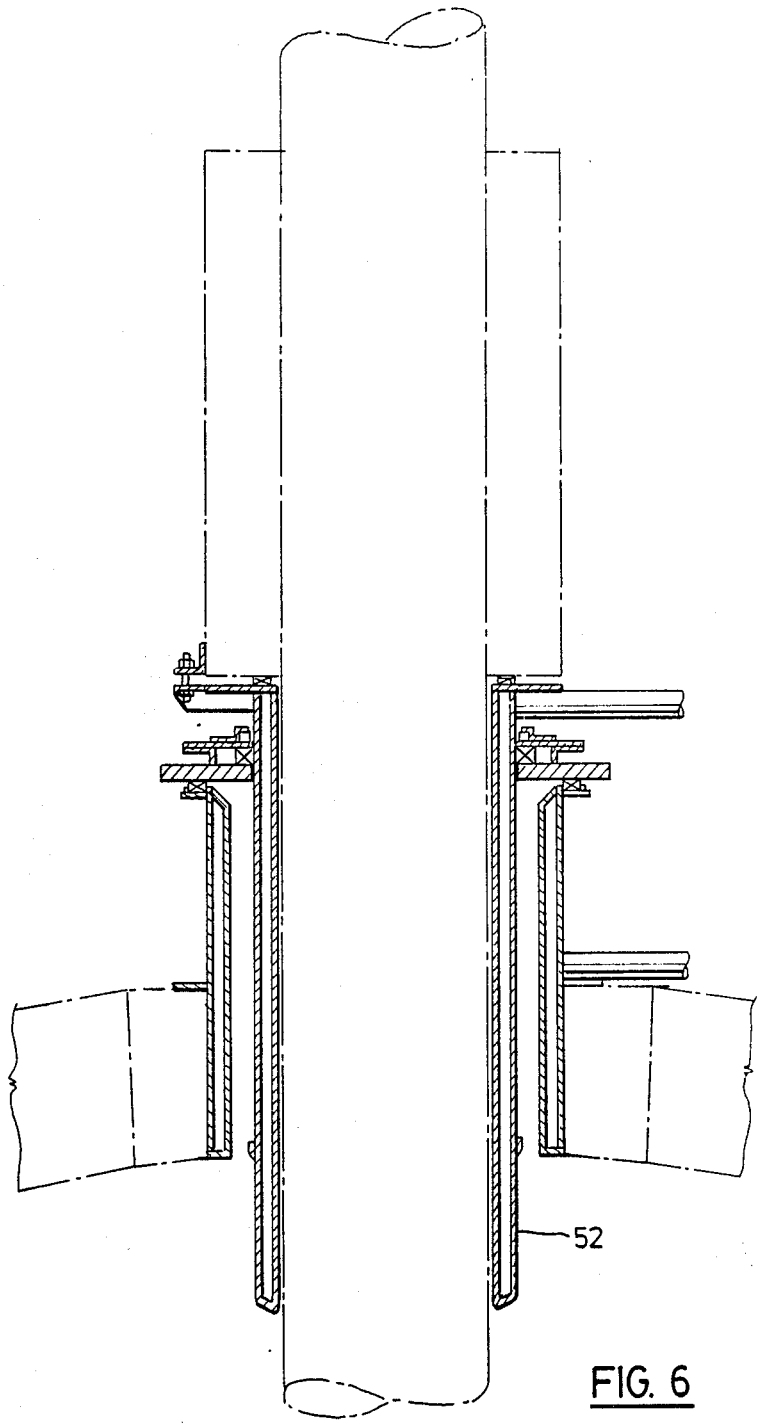
FIG. 6 is a view corresponding to FIG. 4 and showing an electrode assembly in accordance with a third embodiment.

In some instances it may be desirable to extend the annulus 34 vertically to provide arrangements such as those shown in FIGS. 4, 5 and 6. In FIG. 4, the annulus 34 is replaced by a water cooled sleeve in portions 46 and 48. The portion 46 extends through the opening 20, and defines a passageway sufficiently long to shroud the sleeve 24 even when the latter is in its lowermost position. The external surface of the portion 46 of the sleeve extending into the furnace has a refractory coating 50. Such an arrangement may be necessary in some cases to shield the sleeve 24 from exceptionally severe spattering within the furnace. The portion 48 provides an upward extension of the opening 20 which reduces the extent to which the sleeve 24 needs to project within the furnace. The arrangement of FIGS. 4 and 5 has the disadvantage that it applies additional loading to the furnace roof, and the simplified arrangements using an annulus 34, or a shorter sleeve 52 as shown in FIG. 6, will often be adequate.

It should also be understood that not all electric arc furnaces even have a roof, and in the absence of such a roof, the annulus or sleeve is of course not required.

Figure 8:
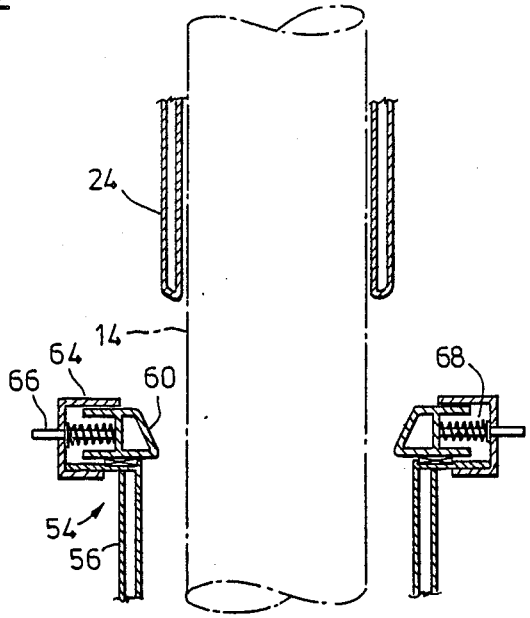
FIG. 8 is a view corresponding to FIG. 3 and showing the fourth embodiment.
Figure 7:
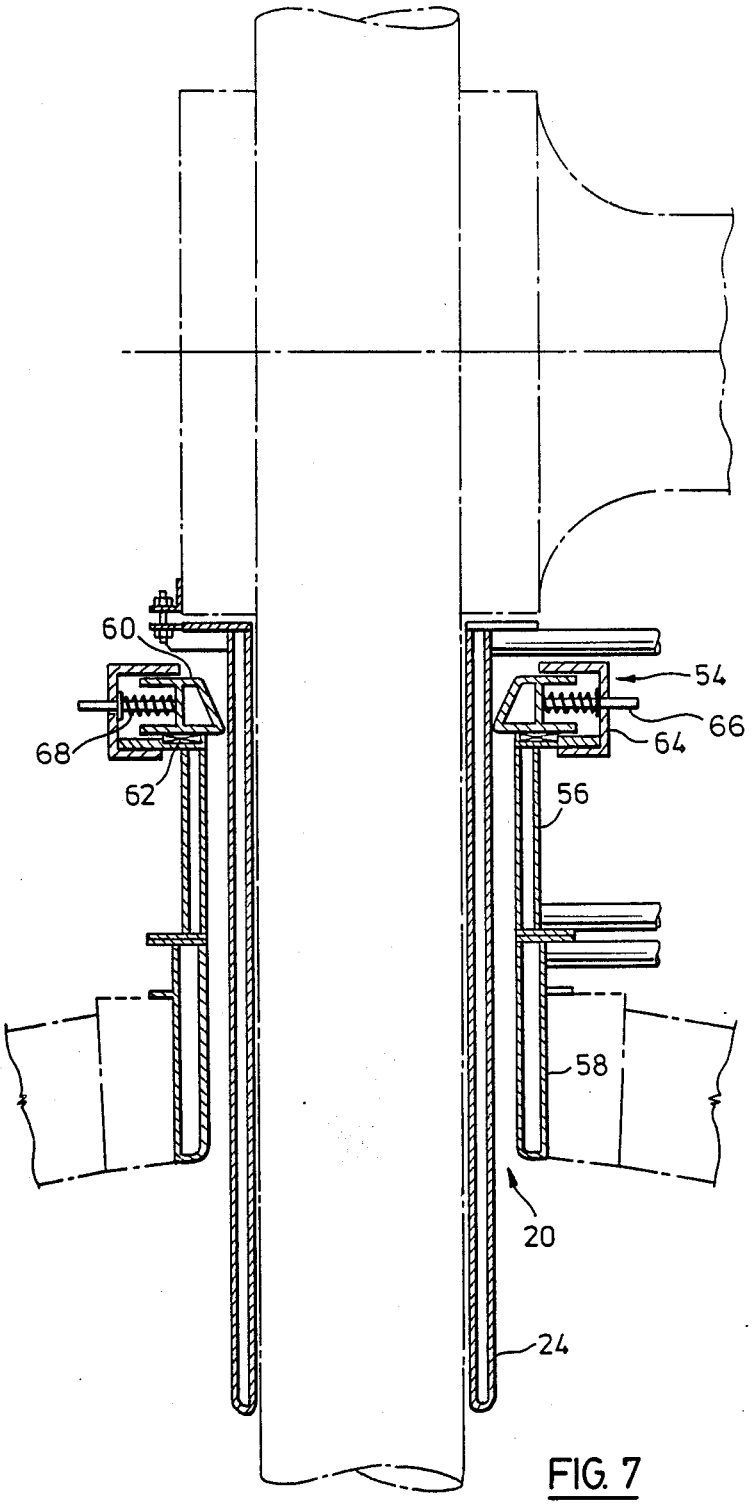
FIG. 7 is a view corresponding to FIG. 4 and showing a fourth embodiment.

Referring now to FIGS. 7 and 8, an alternative form of seal 54 is illustrated, which remains captive on the upper portion 56 of two water cooled sleeve portions 56, 58 defining the passage 20 through the furnace roof. The seal comprises an annular seal member 60 defining a frusto-conical passage, the narrow end of which will just pass the sleeve 24. The seal member rests on an annular bearing pad 62 within a holder 64, within which the seal member is urged towards a centred position by locating pins 66 and springs 68. The sleeve 24, which in this case lacks a lip 44, can withdraw from the member 60 when it is desired to lift the electrodes beyond their normal range of movement. The tapered opening at the top of the element 60, and the centering action of the springs 68, assist the sleeve to re-enter the seal 60 when the electrode is lowered. Since the interengaging parts are water cooled and shielded from the heat of the furnace, a fairly small clearance is permissible between the seal 60 and the sleeve 24.

Figure 9:
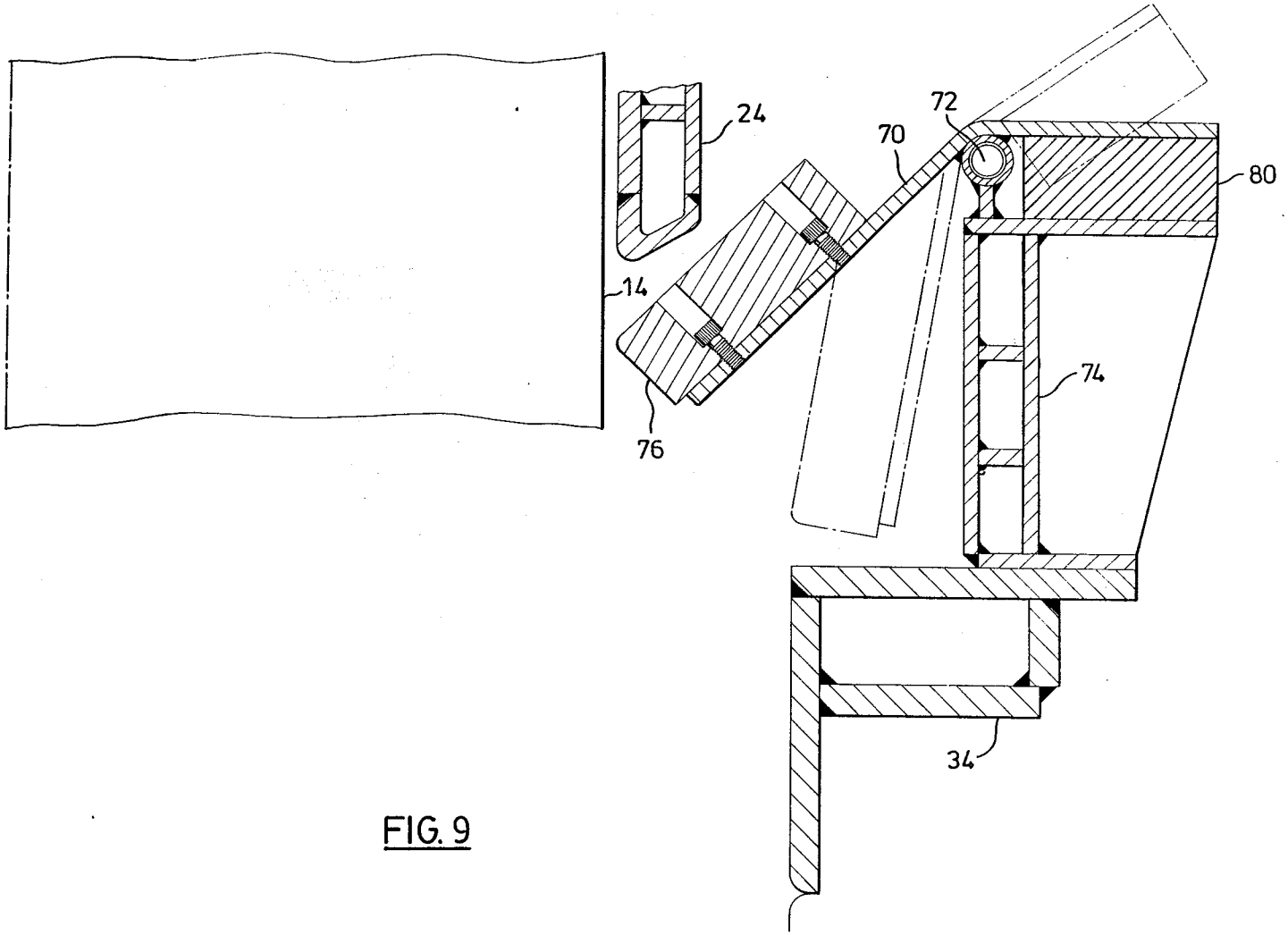
FIG. 9 is a fragmentary vertical section showing parts of a fifth embodiment.

Particularly where accumulation of foreign matter on the sleeve 24 is a problem, the arrangement shown in FIG. 9 may be preferred. Here a seal assembly is mounted on the annulus 34 (see FIGS. 1 and 2), and comprises a plurality of hinged segments 70 (only one is shown), connected by hinges 72 to a mounting ring 74 supported on the annulus 34. Each segment carries at its inner end a graphite sealing element 76 which is urged inwardly and upwardly towards the sleeve 24 by a counterweight 80 at the outer end of the segment. The sealing element can, because of its hinged mounting, ride over obstructions on the surface of the sleeve 24 as the electrode moves up and down. The geometry of the arrangement precludes a perfect seal as the segments hinge independently, but a large measure of control can nevertheless be exercised over gas flow into or out of the furnace.

I claim:

1. An electric arc furnace having a roof, a plurality of vertically movable electrode assemblies each comprising a consumable electrode consisting of a plurality of consumable electrode elements coupled end to end in vertical alignment, an electrode clamp in electrical current transfer and frictional engagement with said electrode at a level on the electrode which will be above said furnace roof throughout the range of movement of said electrode, said assemblies having a normal range of movement during operation of the furnace, and an additional range of movement upward clear of the furnace roof, a fluid cooled sleeve fixedly attached to the electrode clamp of each assembly in an orientation in which it extends downwardly from the electrode clamp to form a shroud disposed concentrically around the electrode and depending into the furnace, the electrode being a spaced fit in the sleeve and the sleeve being free of internal structure engaging the electrode, whereby longitudinal movement of the electrode through the electrode clamp is free of resistance by structure depending from said clamp, and free of structure preventing its withdrawal from the furnace, the vertical extent of the sleeve below the clamp being such that its lower end depends beneath the furnace of roof over at least part of the range of vertical movement of the assembly occurring during normal operation of the furnace, and such that the sleeve ends short of arcing proximity to the highest anticipated level at which conductive material will occur within the furnace, the furnace further comprising means for defining a passageway with clearance for the sleeve of each electrode through the furnace roof, the vertical extent of the sleeve being such that it will extend into said passageway throughout its normal range of movement during operation of the furnace, and beneath said passageway during at least part of said range of movement, an annular seal spanning said clearance being provided sliding on the external surface of each sleeve and normally supported by the associated passageway defining means, and means being provided retaining each seal on the external surface of its associated sleeve when the latter is withdrawn from its associated passageway defining means.

2. An electrode assembly according to claim 1, wherein the sleeve is fabricated from stainless steel.

3. An electric art furnace as claimed in claim 1, wherein each seal comprises an annular sealing ring which normally rests on a seating on top of the passageway defining means, and an annular sealing element supported by the ring, and wherein a lip is provided on the external surface of the sleeve to limit its upward withdrawal through the ring.

4. An electric arc furnace as claimed in claim 1, wherein each seal is captive at the top of the passageway defining means and defines a tapered top entry thereto for the bottom end of the sleeve.

5. An electric arc furnace as claimed in claim 4, wherein the seal comprises an annular holder supported by and concentric with the passageway defining means, an annular seal ring within the holder and defining a central opening from top to bottom, and means within the holder urging the sealing ring towards a centered position.

6. An electric arc furnace as claimed in claim 4, wherein the seal comprises a plurality of segments individually hinged around the periphery of the passageway defining means, each segment having a counterweight outwardly of its hinge, and a seal element inwardly of its hinge such that the seal elements are levered inwardly and upwardly against the sleeve.

7. An electric arc furnace as claimed in claim 1, wherein each passageway defining means is a fluid cooled annulus.

8. An electric arc furnace according to claim 7, wherein the passageway defining means comprises a fuid cooled sleeve which extends substantially upwardly above the furnace roof.

9. An electric arc furnace according to claim 7, wherein the passageway defining means comprises a fluid cooled sleeve which extends substantially downwardly below the furnace roof.

10. An electric arc furnace according to claim 1, wherein each passageway defining means comprises a fluid cooled sleeve of sufficient extent substantially to shroud the sleeve extending from the electrode clamp from the interior of the furnace throughout the normal range of electrode movement.

* * * * *